US011276253B2

(12) United States Patent
Mølmann et al.

(10) Patent No.: US 11,276,253 B2
(45) Date of Patent: Mar. 15, 2022

(54) PRESENT INVENTION CONCERNS A SYSTEM FOR CONTROLLING TRAFFIC

(71) Applicant: AFFIN AS, Oslo (NO)

(72) Inventors: Bjørn Kjetil Mølmann, Lillestrøm (NO); Harald Furu, Oslo (NO)

(73) Assignee: AFFIN AS, Oslo (NO)

( * ) Notice: Subject to any disclaimer, the term of this patent is extended or adjusted under 35 U.S.C. 154(b) by 590 days.

(21) Appl. No.: 16/087,769

(22) PCT Filed: Apr. 5, 2017

(86) PCT No.: PCT/NO2017/000009
§ 371 (c)(1),
(2) Date: Sep. 24, 2018

(87) PCT Pub. No.: WO2017/176122
PCT Pub. Date: Oct. 12, 2017

(65) Prior Publication Data

US 2019/0114843 A1 Apr. 18, 2019

(30) Foreign Application Priority Data

Apr. 5, 2016 (NO) ..... 20160540

(51) Int. Cl.
*G06Q 50/30* (2012.01)
*G08G 1/0967* (2006.01)
(Continued)

(52) U.S. Cl.
CPC ..... *G07B 15/063* (2013.01); *G06Q 50/30* (2013.01); *G07B 15/02* (2013.01); *G08G 1/0175* (2013.01);
(Continued)

(58) Field of Classification Search
CPC ..... G07B 15/063; G07B 15/02; G06Q 50/30; G06Q 2240/00; G08G 1/0175; G08G 1/096775
See application file for complete search history.

(56) References Cited

U.S. PATENT DOCUMENTS 5,583,765 A * 12/1996 Kleehammer ..... G01G 19/03 250/338.5
6,104,299 A * 8/2000 Brusseaux ..... G08B 21/12 340/603
(Continued)

FOREIGN PATENT DOCUMENTS

EP 2390861 11/2011
EP 2390861 A1 * 11/2011 ..... G01C 21/34
(Continued)

OTHER PUBLICATIONS

Todd Litman, "Distance-Based Charges; A Practical Strategy for More Optimal Vehicle Pricing", published by Transportation Research Board 78th Annual Meeting Session 458 Paper No. 99-0678 on Jan. 1999 (Year: 1999).*
(Continued)

*Primary Examiner* — Omar Zeroual
(74) *Attorney, Agent, or Firm* — Jeffrey S. Melcher; Melcher Patent Law PLLC

(57) ABSTRACT

A system (200) for controlling road traffic comprises measurement station (210) for determining air pollution in an urban area comprising pollution zones (221-223) with predetermined geographical boundaries. A central system is configured to charge a pollution fee to a vehicle (10) moving in the pollution zone when the air pollution exceeds a threshold value. Different vehicles are charged different fees, e.g. based on their function and emission. A variable message sign (240) warns of the increased fees, so most private cars choose alternative routes (232, 233) around the
(Continued)

pollution zone (222, 223), but allow motorists willing to pay a substantial pollution fee to use route (231). Heavy diesel vehicles may be exempt from pollution fees along a direct route (231) through the pollution zone to keep them away from small roads and residential areas. A method using mobile devices for registering passengers for a passenger discount is also described.

22 Claims, 6 Drawing Sheets

(51) Int. Cl.
*G07B 15/02* (2011.01)
*G07B 15/06* (2011.01)
*G08G 1/017* (2006.01)

(52) U.S. Cl.
CPC ... *G08G 1/096775* (2013.01); *G06Q 2240/00* (2013.01)

(56) References Cited

U.S. PATENT DOCUMENTS 6,234,390 B1 * 5/2001 Rabe ..... G07F 17/0014 235/384
7,321,317 B2 * 1/2008 Nath ..... G06Q 30/0284 340/425.5
7,603,138 B2 * 10/2009 Zhang ..... G01D 21/00 455/556.1
7,818,204 B2 * 10/2010 Solomon ..... G08G 1/0104 705/13
8,047,052 B2 * 11/2011 De Vries ..... G07B 15/063 73/23.31
8,171,136 B2 * 5/2012 Petite ..... H04B 1/3827 709/224
8,294,899 B2 * 10/2012 Wong ..... G01S 17/95 356/437
8,428,814 B2 * 4/2013 Tripathi ..... G07C 5/008 701/31.4
8,478,603 B2 * 7/2013 Boss ..... G06Q 10/06 705/1.1
8,515,614 B2 * 8/2013 Bernard ..... B60K 35/00 701/29.1
8,812,352 B2 * 8/2014 Boss ..... G06Q 30/04 705/13
8,903,646 B2 * 12/2014 Althen ..... G06Q 99/00 701/411
9,773,355 B2 * 9/2017 Mitchell ..... H04L 67/42
10,112,618 B2 * 10/2018 Borrel ..... G01N 33/0004
10,268,198 B2 * 4/2019 Mantripragada ..... G05D 1/104
10,887,722 B2 * 1/2021 Borrel ..... G01N 33/0075
11,100,357 B2 * 8/2021 Wang ..... G06K 9/58
2002/0107634 A1 * 8/2002 Luciani ..... G08G 1/0104 701/117
2004/0119609 A1 * 6/2004 Solomon ..... G07B 15/063 340/928
2005/0173523 A1 * 8/2005 Yushio ..... G06Q 40/02 235/384
2008/0033644 A1 * 2/2008 Bannon ..... G06F 16/9537 701/414
2008/0065568 A1 * 3/2008 Dawson ..... G06F 16/10 705/400
2009/0295599 A1 * 12/2009 Coffee ..... G07B 15/063 340/928
2009/0306850 A1 * 12/2009 Lee ..... H04Q 9/00 701/31.4
2010/0024521 A1 * 2/2010 De Vries ..... G06Q 30/06 73/23.31
2010/0106567 A1 4/2010 McNew
2010/0156670 A1 * 6/2010 Hamilton, II .... G08G 1/096741 340/928
2010/0161391 A1 * 6/2010 Ashby ..... G06Q 30/02 705/13
2010/0161392 A1 * 6/2010 Ashby ..... G06Q 30/0284 705/13
2010/0201505 A1 * 8/2010 Honary ..... G08G 1/207 340/425.5
2010/0211260 A1 * 8/2010 De Sanctis ..... G07C 5/0808 701/31.4
2011/0077807 A1 * 3/2011 Hyde ..... G06Q 30/02 701/22
2011/0077808 A1 * 3/2011 Hyde ..... G06Q 10/08 701/22
2011/0137573 A1 * 6/2011 Evans-Beauchamp ..... G01M 15/10 702/24
2011/0202393 A1 * 8/2011 DeWakar ..... G06Q 20/3278 705/13
2011/0257869 A1 * 10/2011 Kumar ..... B61L 25/025 701/103
2011/0307119 A1 * 12/2011 Basir ..... G07C 5/008 701/1
2012/0293315 A1 * 11/2012 Schunder ..... G08G 1/096775 340/438
2013/0110284 A1 * 5/2013 Kadaba ..... E01H 10/007 700/240
2013/0185001 A1 * 7/2013 Cardoso ..... G01M 15/102 702/24
2013/0297212 A1 * 11/2013 Ramer ..... H05B 47/175 702/1
2014/0039988 A1 * 2/2014 Londergan ..... G06Q 30/0207 705/14.1
2014/0074692 A1 * 3/2014 Beerle ..... G06Q 20/3224 705/39
2014/0149190 A1 * 5/2014 Robinson ..... G07B 15/063 705/13
2014/0229255 A1 * 8/2014 Scofield ..... G06Q 30/0207 705/14.21
2014/0278840 A1 * 9/2014 Scofield ..... G08G 1/096775 705/13
2014/0297220 A1 10/2014 Raffa
2014/0309864 A1 * 10/2014 Ricci ..... B60N 2/0244 701/36
2014/0315528 A1 * 10/2014 Gupta ..... H04L 67/12 455/414.2
2014/0375480 A1 * 12/2014 Morgan ..... H04W 4/021 340/990
2015/0006018 A1 * 1/2015 Tesanovic ..... G07C 5/0808 701/29.6
2015/0021389 A1 * 1/2015 Gravelle ..... G06Q 50/30 235/375
2015/0025945 A1 * 1/2015 Kleven ..... G01G 3/16 705/13
2015/0077737 A1 * 3/2015 Belinsky ..... G08B 17/107 356/51
2015/0134174 A1 * 5/2015 Preece ..... B60L 58/13 701/22
2015/0197248 A1 * 7/2015 Breed ..... G08G 1/167 701/93
2015/0199664 A1 * 7/2015 Buckman ..... G06Q 20/42 705/13
2015/0241230 A1 * 8/2015 Davidson ..... G06K 9/00812 701/533
2015/0279122 A1 * 10/2015 Lorenzen ..... H04L 67/12 705/13
2015/0324807 A1 * 11/2015 Pacheco ..... G06Q 40/04 705/317
2016/0297324 A1 10/2016 Taylor
2016/0343175 A1 11/2016 Nyalamdugu
2017/0041205 A1 * 2/2017 Rangel ..... H04L 41/0853
2017/0076509 A1 * 3/2017 Scofield ..... A61B 5/02055
2017/0085632 A1 * 3/2017 Cardote ..... H04W 4/70
2017/0168487 A1 * 6/2017 Mantripragada ..... G05D 1/104
2017/0364719 A1 * 12/2017 Boehm ..... G07B 15/063
2018/0170349 A1 * 6/2018 Jobson ..... B60W 20/40
2018/0322710 A1 * 11/2018 Hohenacker ..... G08G 1/149
2019/0012909 A1 * 1/2019 Mintz ..... G08G 1/017

(56) References Cited

U.S. PATENT DOCUMENTS

| | | | | |
|---|---|---|---|---|
| 2019/0316926 | A1* | 10/2019 | Wang | G01C 21/3438 |
| 2020/0211142 | A1* | 7/2020 | James | G06Q 30/0284 |
| 2021/0326804 | A1* | 10/2021 | Williams | G06Q 10/0833 |

FOREIGN PATENT DOCUMENTS

| | | | | |
|---|---|---|---|---|
| EP | 2819112 | A1 * | 12/2014 | G07C 5/0808 |
| GB | 2545524 | A * | 6/2017 | B60W 20/16 |
| GB | 2576126 | A * | 2/2020 | B60W 10/30 |
| WO | WO-2008032075 | A2 * | 3/2008 | G06Q 50/06 |
| WO | 2017/176122 | | 4/2017 | |

OTHER PUBLICATIONS

Bruce Schaller, "New York City's congestion pricing experience and implications for road pricing acceptance in the United States", published by Elsevier on Mar. 4, 2010 (Year: 2010).*

Tianfang Bernie Fang, "Personal real-time air pollution exposure assessment methods promoted by information technological advances", published by Annals of GIS on Oct. 15, 2012 (Year: 2012).*

International Search Report issued in PCT/NO2017/000009, dated Jun. 22, 2017, pp. 1-2.

Written Opinion issued in PCT/NO2017/000009, dated Jun. 22, 2017, pp. 1-10.

International Search Report issued in PCT/NO2017/000010, dated Jul. 6, 2017, pp. 1-2.

Written Opinion issued in PCT/NO2017/000010, dated Jun. 22, 2017, pp. 1-8.

* cited by examiner

PRESENT INVENTION CONCERNS A SYSTEM FOR CONTROLLING TRAFFIC

BACKGROUND

Field of the Invention

The present invention concerns a system for controlling traffic.

Prior and Related Art

International standards and regulations on local air quality typically regard substances with adverse effects on public health and/or the environment.

For example, nitrogen oxides ($NO_x$), i.e. NO and $NO_2$, combine with volatile organic compounds (VOCs), e.g. methane ($CH_4$), benzene and other organic solvents, to form ground level ozone or smog, which affects lungs and bronchia. In 2008 the Worlds Health Organization estimated that ground level ozone causes approximately 22000 premature deaths per year in 25 countries in the EU. Due to the required chemical reactions between $NO_x$ and VOCs in the atmosphere, the concentration of $NO_x$ is representative for the health hazard associated with ground level ozone. Moreover, the concentration of $NO_x$ or $NO_2$ are equivalent, because the ratio $NO/NO_2$ in the atmosphere is constant at a given temperature. Thus, either concentration serves as an important measure for public health hazard.

Important sources for tropospheric $NO_x$ include lightning and combustion, e.g. from homes, industry, ships and road traffic. Of these, road vehicles is a major contributor to ground level $NO_x$ because they emit exhaust at ground level, while residential heating and other stationary combustion sources typically emit fume gases through tall chimneys. Accordingly, the concentration of ground level $NO_x$ has decreased significantly in Europe and US since catalytic converters became mandatory in the respective regions.

Particular matter, $PM_{2.5}$ and $PM_{10}$ are also hazardous to public health. $PM_{2.5}$ are particles with diameter less than 2.5 μm. Important sources include soot from combustion similar to the sources for $NO_x$. $PM_{10}$ are particles with diameters 2.5 μm to 10 μm. Important sources for dangerous airborne particles $PM_{10}$ include dust stirred up by road vehicles.

Other substances defining local air quality have negative effects primarily on the environment. For example, sulphur oxides ($SO_x$) cause acid rain, which used to be a major problem. However, the concentrations of $SO_x$ have decreased significantly due to strict and enforced limits of sulphur concentrations in fuel in Europe and the US. Other pollutants include organic lead, which also used to be a major hazard to public health in Europe and the US. Greenhouse gases, e.g. $CO_2$, may be monitored locally for political reasons, but have little or no immediate effect on public health or local environment.

In particular, air quality authorities monitor and compare concentrations of $NO_2$ and dangerous airborne particles ($PM_{10}$) as measures of air quality. For example, Clean Air in London (CAL) reports that the current concentration of $NO_2$ is greater in London than in Beijing, whereas the concentration of $PM_{10}$ is greater in Beijing than in London. The European Environment Agency (EEA) defines concentrations of $NO_2$ above 200 $\mu g/m^3$ one-hour average as harmful. Accordingly, Clean Air in London (CAL) counts the number of Bad Air Hours in which this limit is exceeded at a measurement station. Similar limits are defined in other countries, e.g. by the Environmental Protection Agency (EPA) in the US. All of the organizations mentioned above run websites with comprehensive information and statistics on ground level air pollution.

Emission standards define limits and targets for emission from vehicles. In particular, emission from diesel cars has received public attention due to the Volkswagen scandal in 2015, and the previously known fact that diesel cars generally emit more $NO_x$ during real-world driving than during tests. For example, in 2014 ICCT found an average $NO_x$ emission of 560 mg/km from 15 diesel cars from different manufacturers during real-world driving. All cars were approved under Euro 6 or the US equivalent Tier 2 Bin 5/ULEVII, and thus had a 'type approved' emission of 80 mg/km. See Franco et al.: "Real-world exhaust emissions from modern diesel cars", ICCT 2014, for details.

Emission should not be confused with concentration. In particular, a petrol car typically emits less $NO_x$ than a corresponding diesel car. However, the number of private cars with petrol engines make petrol engines a significant source for $NO_x$. In some urban areas, petrol engines contribute more to the concentration of $NO_x$ than diesel engines.

As noted, dangerous airborne particles ($PM_{10}$) is another major hazard to public health. An important source for this pollutant is tarmac abrasion and dust stirred up by vehicles. Vehicles with studded tires cause more wear and generate more $PM_{10}$ than vehicles without studded tires, and heavy vehicles contribute more than lighter vehicles.

The air pollution in urban areas depends on geographic and atmospheric conditions. For example, on cold winter days a temperature inversion may cause a lid of cold air to trap the air pollution in a city surrounded by mountains or hills. Cold weather may also increase the concentration of $NO_x$ at ground level because cold engines may emit more $NO_x$ than warm engines. On the other hand, high temperatures drive the chemical reactions that cause tropospheric ozone. Thus, in some areas smog may be a greater problem during the summer than during the winter. Some areas are subject to bad air quality both on cold winter days and on hot summer days.

Reducing road traffic is important to improve the local air quality and thereby reduce the adverse health effects of air pollution. To achieve this, it has been suggested to ban private petrol and diesel vehicles in certain areas on certain dates based on the registration number. This suggestions disregard that some private cars are actually needed, e.g. due to missing or infrequent public transport in some areas, and may be considered unfair by the population in rural areas. A similar suggestion is to ban diesel vehicles in certain areas on 'bad air days'. This proposal will have limited effect in areas where petrol engines contribute more to the $NO_x$-concentration than diesel engines, e.g. due to a high number of private cars with petrol engines compared to the number of diesel engines. Another problem with these suggestions is that road traffic may flow around the restricted areas, e.g. to residential areas or smaller roads. The redirected traffic flow may reduce air quality in residential areas and/or increase total maintenance costs as streets and small roads are not designed for many or heavy vehicles.

Most or all urban areas have a traffic control system that allows traffic authorities to monitor the flow of traffic, e.g. using traffic counters, CCTV-cameras etc. In case of an incident or accident, the traffic authorities may close a lane for a limited time and distance, e.g. by means of traffic lights or by asking the police to direct the traffic. In many areas, traffic information from these systems are provided in real time to the public, e.g. through broadcast messages received in car radios and/or on variable message signs (VMS)

mounted on gantries above major roads. The general purpose is to advise motorists of alternative routes. Real time, local traffic information may also be included in commercial navigation applications or published on websites. For example, Hampshire county runs a public website (www.romanse.org.uk) that is available via smartphone, tablet or PC and provides real-time feeds from CCTV cameras on major roads, tweets from motorists, etc. Motorists may check the website before they leave home, or on a tablet or car console while driving.

Automatic number plate recognition (ANPR) is commonly used for automatic enforcement of speed limits, electronic toll collection and numerous other purposes. Specifically, an ANPR system recognise the registration number from a number plate, and uses the registration number for lookups in a central database, e.g. a vehicle register, to retrieve information about the owner and vehicle, e.g. motor type. Some cities, e.g. London, Stockholm and Gothenburg, use ANPR systems to charge a congestion fee. In these systems, motorists are charged a fixed daily fee if they enter, leave or move around in a payment zone at certain times, e.g. between 7 a.m. and 6 p.m. Monday to Friday. Fixed, and in some systems also mobile, cameras transmit video streams of vehicles entering, leaving or moving in the payment zone to a data centre for processing. The processing includes optical character recognition on images from the video stream and a subsequent lookup in a vehicle register to determine if the required fee is paid. Those who have not paid are charged a fine.

Fees may also compensate for wear and tear. For example, vehicles with studded tires may be eligible for an extra fee, as studded tires are more abrasive and generate more dust than tires without studs.

In general, fees on usage and/or environmental impact are more likely to gain public acceptance than arbitrary fees or bans, especially if the fees charged are seen to improve the local environment, e.g. by investments in public transport.

U.S. Pat. No. 7,320,430 B2 discloses a toll system with variable rates, in which dynamic toll rates are determined based upon the difference between actual average speeds on a tolled segment and a non-tolled segment between two locations. The average speeds are determined by vehicle detectors, e.g. ANPR-systems.

ANPR and similar systems have a potential for mass surveillance, which has received increased public attention, in particular since documents published in 2013 revealed that the US National Security Agency (NSA), helped by telecom companies and European governments, monitored US and EU citizens indiscriminately. In Europe, a debate regarding the Data Retention Directive (DRD) further raised public attention to privacy. The DRD was an EU directive requiring member states to store telecom data for every citizen, and was actively supported by European governments until the Court of Justice of the EU deemed it disproportionally intrusive. These and similar incidents have made a significant fraction of the population aware that even their domestic government may circumvent privacy acts and other regulations intended to separate legitimate surveillance of suspected criminals from illegal surveillance of ordinary citizens, e.g. by providing data to a 'friendly' foreign security agency. The point here is public awareness of what domestic and foreign agencies can do, not what they actually do or what legal basis they might have. Thus, a significant, and possibly increasing, fraction of ordinary citizen are sceptical to systems with potential for mass surveillance, especially systems run by 'authorities'.

The general objective of the present invention is to solve or reduce at least one of the problems above while retaining the benefits of prior art. Specifically, the proposed solution should reduce road traffic in polluted areas significantly without banning certain vehicles. The solution should require little or no manual enforcement, and it should not increase the air pollution in residential areas or maintenance costs for small roads or streets. In addition, the proposed solution should preferably use existing systems and technology to reduce cost and risk, and all stakeholders should consider the system fair and secure.

SUMMARY OF THE INVENTION

These and other objectives are met by a system for controlling traffic and a method for computing a passenger discount according to the claims. Additional features and benefits appear from the independent claims.

In a first aspect, the invention concerns a system for controlling road traffic, comprising a display for informing motorists, a measurement station for measuring a substance concentration in ambient air and a central system. The central system is configured to charge a pollution fee to a vehicle moving in a pollution zone with predetermined geographical boundaries when the substance concentration in the pollution zone exceeds a threshold value. The display is configured to inform motorists of a raised pollution fee in the pollution zone.

The temporary pollution fee charged in the pollution zone should be sufficiently large to divert a significant fraction of the traffic around the zone, and may increase with increasing concentration of a harmful substance in ambient air.

Preferably, the substance is selected from a group comprising nitrogen oxides ($NO_x$), particulate matter ($PM_{10}$ and $PM_{2.5}$), sulphur oxides ($SO_x$), lead, volatile organic compounds and carbon monoxide (CO). These substances are considered harmful to public health according to current European regulations.

The substance concentration and the threshold value should be expressed as averages over a predetermined period. This is common practice, as an instantaneous concentration at the measurement station may vary significantly, e.g. due to wind. The predetermined periods may last for one or more hours, months or years.

Preferably, the pollution zone has a predetermined minimum duration. This prevents that a temporary decrease in a running average causes the pollution zone to disappear and return shortly after when the running average exceeds the threshold value. There should be a similar minimum duration before the zone is re-established after being cancelled.

Preferably, the pollution fee comprises a fee rate depending on properties of the vehicle multiplied by usage data depending on the substance concentration. Thus, two different vehicles with the same usage may be charged different fees, e.g. charging little or no fees to heavy vehicles to keep them on main roads designed for the load. The usage factor favours a little used vehicle over a much used vehicle of the same kind.

The system may differentiate between different classes of vehicles, e.g. by making a private car, a private utility vehicle, a public utility vehicle and an emergency vehicle eligible for different pollution fees if all other parameters relevant for the pollution fee are equal. For example, the pollution fee for an emergency vehicle may be zero, and private cars may have higher fee rates than other vehicles in an area.

In some embodiments, the pollution fee increases with the weight of the vehicle. The weight may include load, i.e. such that a fully loaded vehicle is charged a different fee than an equal but empty vehicle. Weight may be combined with mileage, i.e. the actual distance travelled, to a fee for road wear and/or a pollution fee for dangerous airborne particles, $PM_{10}$.

Mileage is a usage parameter that may be combined with other fee rates as desired, e.g. a non-zero fee rate for vehicles with studded tires to produce a fee for studded tires.

In some embodiments, the pollution fee increases with increasing emission from the vehicle. The emission may be provided as a fixed factor reflecting real world emission, e.g. 500-600 mg/km of $NO_x$ from modern diesel cars as opposed to the alleged 80 mg/km measured in lenient tests and the much lower, yet significant, emission from petrol engines. In alternative embodiments, sensors placed in the exhaust of the vehicle may provide real-world emission values.

In order to improve air quality, e.g. reduce concentrations of substances that are harmful to humans in an urban area, it may be desirable to reduce road traffic, in particular the number of private cars used for commuter traffic in the urban area. A passenger discount on the pollution fees may help. For this, an embodiment of the system comprises public server for recording a journey ID and an associated passenger count; a vehicle server within the vehicle and a machine-readable passenger token for providing a passenger ID unique for each passenger. The public server and the vehicle server are nodes in the public network, and the public server is configured to record the passenger count as the number of distinct passenger IDs that is/are read by the vehicle server over a short-range connection during a journey identified by the journey ID.

In essence, an empty passenger list is created at the beginning of a journey, e.g. to or from work. During the journey, digital passenger IDs are read from a passenger token, e.g. an ID-card or a smartphone, and added to the passenger list. The short-range connection, e.g. a USB-cable, WiFi or Bluetooth, ensures that the passenger token is close to the vehicle server, i.e. inside the vehicle. The passenger may prove that he or she too is close to the vehicle server by entering a secret on the vehicle server's console. The number of distinct passenger IDs at the end of the journey may be used to compute the passenger discount.

BRIEF DESCRIPTION OF THE DRAWINGS

The invention will be explained with reference to exemplary embodiments and the accompanying drawings, in which.

DETAILED DESCRIPTION OF A PREFERRED EMBODIMENT

The drawings are schematic and not to scale. For ease of understanding, numerous details known to a skilled person are omitted from the drawings and the following description.

Figure 1:
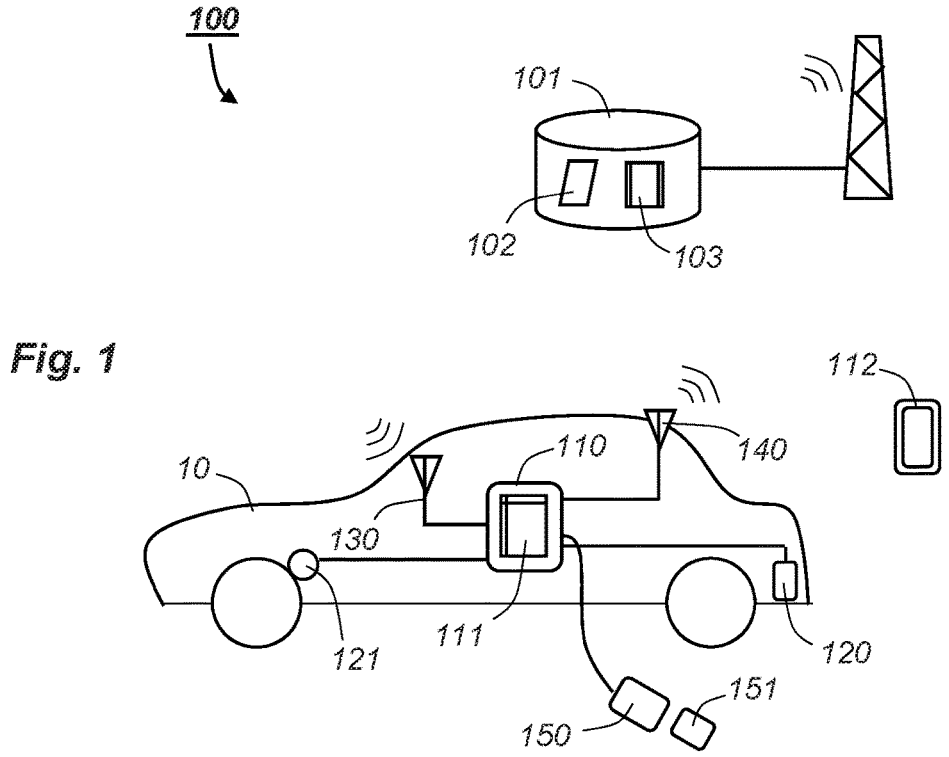
FIG. 1 illustrates a system for charging usage fees to a vehicle.

FIG. 1 illustrates a system 100 for charging fees disclosed in our co-pending application NO20160003A1. The main parts of the system 100 is a central system 101 and a secure device 110 mounted in a vehicle 10. The general purpose is to provide fees based on usage while addressing security and privacy issues. In particular, digital security techniques similar to those used in net banking enables authorities to trust origin and integrity of fee data.

Specifically, the central system 101 has a dataset 102 and associated functions 103 for acquiring and storing fee data, and for collecting fees. Proven cryptographic techniques ensure that the origin of fee data can be assured without manual control. These techniques also ensure that no one, including the vehicle owner, can alter fee data in transit from the secure device 110, e.g, over a public network 140. While the system 100 requires a private key for each vehicle, there is no need for a central repository of private keys. In fact, the British GCHQ 1977 developed public key cryptography to reduce the cost of keeping private keys secret and for couriers to carry codes all over the world. Similarly, current net banking applications uses electronic devices to provide secure one-time codes. The banks do not need a register of secret one-time.

Figure 11:
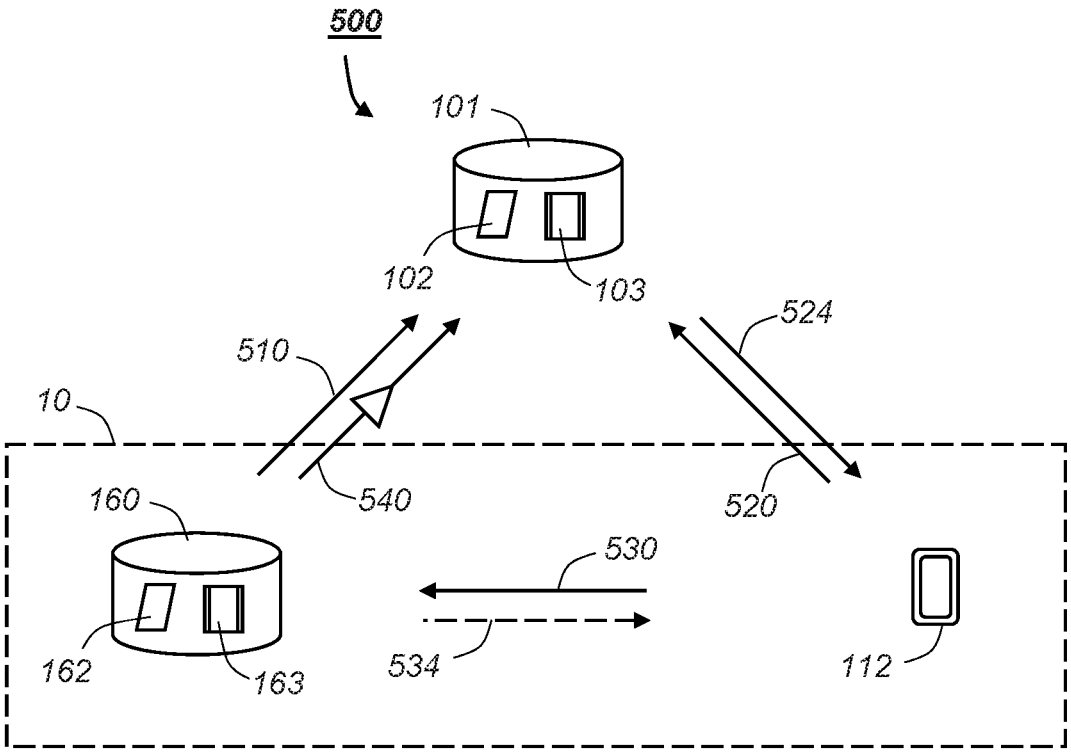
FIG. 11 illustrates a method for computing a passenger discount using digital security.

The secure device 110 collects fee data from emission sensor 120, an odometer 121 and a positioning system 130, e.g. GPS. A user terminal 112, e.g. a car console, smartphone, tablet or PC display fee data to the vehicle owner, but does not permit changing the data. The emission sensor 120 measures real-world emissions in the exhaust of the vehicle 10. This enables fees based on actual emission rather than unreliable 'type approved' data produced by car manufacturers and lenient tests. The odometer 121 is installed in all vehicles, and just needs a connection to the secure device 110 to provide an accurate mileage for the vehicle 10. The positioning system 130 provides data to the secure device 110, whereas an ANPR-system, e.g. an electronic toll station, records a time and location for the vehicle 10 in a central system. The secure device 110 may compute the relevant fee from GPS-data and provide the resulting fee over the network 140. A card reader 150 and a personal ID-card 151 may be used to authenticate passengers, e.g. for a passenger discount as shown in FIG. 11. The central system 101 have no other use for the position data than collecting fees, and should therefore accept a fee from the secure device 110 provided the data are reliable. Thus, the vehicle owner may keep the positioning data for comparison with historic data, trend analysis etc., while the central systems receives data sufficient to collect the fees. This reduces the risk for misuse of private data.

NO20160003A1 proposes different fee rates for different classes, e.g. higher fee rates for private cars than for utility vehicles and zero fee rates for emergency vehicles. The fee rates may be further divided by secondary criteria, e.g. 'type' reflecting weight, the environmental footprint of manufacture or whether the vehicle has studded tires or not. The fee rates are multiplied by usage data, e.g. mileage or real-world emission to obtain fees. The resulting fees are, for example, useful for implementing policies.

Figure 2:
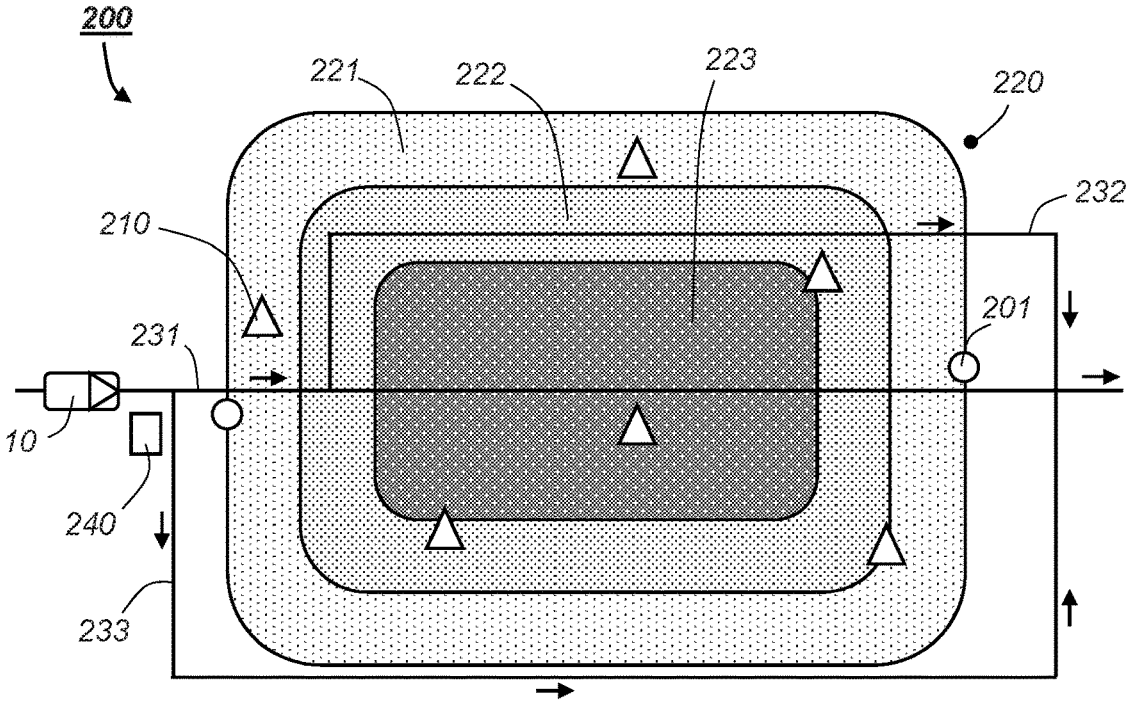
FIG. 2 illustrates the principles of the system of the present invention.

The present invention expands these ideas and propose fees based on air-pollution, i.e. concentrations of certain substances in ambient air. Specifically, a temporary pollution fee could be charged in a temporary payzone when a measured air-quality drops below a predefined threshold in the zone, and thus redirect traffic around the bad air zone. The measured air quality may be based on health hazard, i.e. relate to substances harmful to human health such as $NO_x$ and/or $PM_{10}$. However, the system is not limited to certain pollutants, and may reduce emission of $CO_2$ or other climate gases if desired. The system 200 may be implemented by simple upgrades of existing systems, and does not depend on system 100. However, vehicle owners, and authorities may benefit from real-world data provided by the system 100 as further explained below FIG. 2 illustrates a system 200 implementing usage based fees for different vehicles 10. CCTV cameras, traffic counters, ANPR systems and a control centre commonly found in traffic information or control systems are omitted from FIG. 2 for clarity.

Initially, the system 200 may comprise electronic or manual collection points 201 from an existing toll collection system, a network of commercially available measurement stations 210 and/or a VMS 240 from an existing traffic control system. The initial system will probably comprise several ANPR cameras (not shown) from the former toll collecting system and/or from the former traffic control system. In addition, existing central systems with associated administration and routines for collecting fees, e.g. fiscal fees, may be engaged to collect usage based fees in the system 200. Thus, the system 200 may be established by reuse and relatively small upgrades to existing systems. Once the system 200 is established, there is a need for political revision at regular intervals, e.g. once a year. This is further discussed with reference to FIG. 9

The different shades on zones 220-223 illustrate different levels of air pollution as provided by measurement stations 210. Specifically. 'air pollution' may refer to a concentration of a single substance, e.g. $NO_2$ or $PH_{10}$, or to a weighted sum of such concentrations. On a graphical display, e.g. on a road map displayed on a PC, the zones 221-223 may have different background colours to indicate different levels and/or different kinds of air pollution. Colour schemes will be further described with reference to FIG. 5.

Each measurement station 210 measures one or more concentrations of relevant substances. National or international regulations may define the locations and types of individual sensors. For example, EU directive 2008/50/EC, annex III, regards the location of sampling points for measuring concentrations of $SO_x$, $NO_x$, particulate matter ($PM_{10}$ and $PM_{2.5}$), lead, benzene and CO in ambient air.

The possibilities for implementing an effective policy increases with the size and number of potential zones 221-223, and hence on the density of measurement stations 210.

As in the system 100, the fees in system 200 may conveniently be defined as a fee rate multiplied by usage data.

The fee rates depend on properties of the vehicle. For example, there may be separate classes for private passenger cars, utility vehicles with an approved need to deliver goods, public transport vehicles and emergency vehicles such as police cars, fire trucks and ambulances. Each class may have different fee rates. For example, a private car may be assigned a higher class fee rate than a utility vehicle, and the class fee rate may be zero for emergency vehicles. The vehicle may be eligible for additional fees based on other criteria, e.g. type. For example, a van and a lorry for delivering goods to shops in a central area have different weights, and thus contribute differently to tarmac abrasion and concentrations of $PM_{10}$. Thus, weight may be considered when determining the fee rate.

Fee rates may be multiplied to provide effective fee rates for the vehicle. Thus, the effective fee rate for an emergency vehicle becomes zero when multiplied by zero.

Usage data include emission, mileage and movement within a payzone eligble for an extra fee, e.g. similar to the congestion fees described in the introduction. In addition, the system 200 has an added pollution fee based on data from measurement stations 210. In particular, temporary pollution zones 221-223 are created once a criterion for air quality drops below predefined thresholds. For example, zone 223 might be created if the running average concentration of $NO_2$ in ambient air exceeds 200 $\mu g/m^3$ for two consecutive hours. Once created, a zone with increased fees should exist for a minimum period, e.g. two hours. Otherwise, a running average might temporarily drop below the criterion for creating the zone and cause undesired oscillations, i.e. that the zone exists, then does not exist, then exists, etc.

Vehicles without a secure device 110 providing real-world usage data may be assigned fixed usage data by the central system 101. For example, in a vehicle 10 with a secure device 110 installed, a fee rate for private cars stored in the secure device 110 may be multiplied by the real-world emission of $NO_x$ measured in mg/km by the emission sensor 120 and an accurate mileage in km provided by the odometer 121. The resulting emission fee could be added to a studded tire fee obtained as a studded fee rate times the mileage.

For vehicles without a secure device 110 collecting real-world emission and mileage, the emission measured in mg/km and mileage in km must be assigned fixed values, preferably above average values. Assume for example, that the average real-world $NO_x$ emission from private diesel cars is 560 mg/km and from corresponding petrol cars 50 mg/km. Zero-emission vehicles, regardless of class or types would be assigned emission 0. Assume further that the average mileage for vehicles 10 in temporary payzone 223 is 9 km. Then, once an increased emission fee applies, e.g. if the $NO_x$ concentration in zone 223 exceeds 200 $\mu g/m^3$in two consecutive 'bad air hours', private cars could be charged different $NO_x$ fees, e.g.:

$NO_x$_fee(diesel)=rate_priv_car/mg×600 mg/km×10 km=600×rate_priv_car $NO_x$_fee(petrol)=rate_priv_car/mg×60 mg/km×10 km=60×rate_priv_car $NO_x$_fee(hydrogen)=rate_priv_car/mg×0 mg/km×10 km=0×rate_priv_car Similar emission fees may be charged for other individual pollutants, e.g. soot ($PM_{10}$ and $PM_{2.5}$), $SO_x$ etc., or alternatively a combination of pollutants. The zero-emission vehicle will still be eligible for fees related to mileage, e.g. a general fee for road wear and/or an extra fee for studded tires.

Thus, similar vehicles may be assigned identical fee rates, rate_priv_car in this example, and still be charged different emission fees, In the example above, the diesel car is charged ten times the emission fee charged to the petrol car due to the different emission rates in mg/km. This is likely to reroute most diesel cars around zone 232, while permitting passage for those willing to pay, e.g. due to urgent needs. In contrast, a total ban on diesel cars as described in the introduction would probably be less effective as no petrol cars would be rerouted to routes 232 and 233.

As the mileage is above average, 10 km>9 km in the present example, a majority of vehicle owners would benefit from installing a secure device 110 and connecting it to the vehicle's odometer 121. The benefit for the charging authorities is a reduced need for manual control as described above. Similarly, the emission rates 600 and 60 mg/km are above average values, so a majority of vehicle owners would benefit from installing an emission sensor 120. More important, zero-emission vehicles, i.e. private cars, vans etc., are not eligible for emission fees. This may promote a shift toward zero-emission vehicles, and thus reduce the annual average concentration of $NO_x$.

The system 100 described with reference to FIG. 1 may provide position and time data similar to those from an ANPR-system. As the secure device 110 by itself is likely to reduce the requirements for a central system 101, just installing the secure device 110 may qualify for a fee reduction. This is similar to a bank charging a lower fee for net bank transaction than for transactions requiring a manual effort. As reduced fees and convenience moved bank customers to net banking, reduced fees, improved quality of service and increased privacy may induce motorists to install a secure device 110. If the system 100 is installed, the positioning system 130 and odometer 121 may provide more accurate data for the vehicle's movements in a payment zone than an ANPR system. In addition, the emission sensor 120, if installed, may differentiate fees depending on actual usage.

As mentioned above, the traffic control system may use ANPR to estimate travel times, provide footage from CCTV-cameras and forward any other traffic information, e.g. messages from motorists regarding local incidents, gridlocks, accidents etc. Real time information is typically provided to motorists on variable message signs 240, by broadcasting, on a website, in a navigation system etc. Accordingly, suitable user terminals 112 include a car console, smartphone, tablet, PC and any other device able to connect to a network, download the information and present it to the driver of vehicle 10 before starting or while driving. The same channels may also provide information regarding air pollution, in particular raised fee rates and alternative routes in areas where the pollution exceeds a predetermined level.

Preferred embodiments of the system 200 distinguish between different types of pollution, e.g. concentration of $NO_x$, concentration of $PM_{10}$, etc. These embodiments may provide specific information on what, where, who and alternatives. For example, if the $NO_x$ level is too high, the VMS 240 might read:

"Raised emission fee 4 £/km for private diesel cars in Arfield. Time to Barfield 10 min.

Alternative routes via Carfield (3 £/km, +11 min) or Darfield (2 £/km, +22 min)"

In this example, the estimated travel times (ETTs) to Carfield and Darfield are relative to the ETT to Barfield. In a second example, the concentration of $PM_{10}$ in Barling is too high, and the ETTs are absolute times, and the VMS 240 might read:

"Raised studded tire fee 5 £/km in Barling. Carling: 22 mins Alternative routes:

Via Darling (3 £/km, 33 min); via Earling (no studded tire fee, 44 min)"

Different vehicles may be eligible for different fees when entering the polluted zones, e.g. zone 221. For example, a zero-emission vehicle may avoid an emission fee in zone 221 if the concentration of $NO_x$ is high, but be eligible for a weight and mileage related fee if the concentration of $PM_{10}$ in zone 221 is high.

The fees in zones 221-223 are increased only when the concentrations of predefined substances exceeds predetermined thresholds. Motorists unwilling to pay the increased fees may choose alternative routes. For example, a fee increase for private cars entering zone 221 may cause 60% of the private cars to choose route 233. Of the remaining 40%, another 40% may proceed to zone 223. In this example, the number of private cars in zone 223 would be 0.4×0.4=16% of those entering zone 221. A reduction by 84% in the most polluted zone 223 is greater than the maximum 50% achieved by banning all vehicles based on an odd or even digit on the number plate.

In order to keep heavy vehicles away from residential areas and small roads, the pollution fees for zones 221-223 may apply only to vehicles below a weight limit, e.g. an unloaded weight less than 2500 kg. Thus, heavy vehicles would not be affected by the temporary increase of pollution fees, and hence be inclined to take the shortest and least expensive route, i.e. route 231 in the present example.

Similarly, battery and hydrogen powered private cars may avoid increased emission fees due to an elevated level of $NO_x$ and $PM_{2.5}$ in zones 221-223. In this case, zero-emission private cars would stay on main road 231 and thus reduce the probability for queues on smaller roads, e.g. roads 232 and 233. The ability to proceed through polluted areas, e.g. along route 231 through zones 221-223, without being charged an emission fee provides a benefit to motorists investing in zero-emission vehicles. However, zero-emission vehicles may be eligible for a temporary pollution fee charged due to an increased concentration of particulate matter, e.g. $PM_{10}$, stirred up by all road vehicles.

In general, zero-emission vehicles contribute as much to road wear and $PM_{10}$ as similar vehicles with combustion engines. Zero-emission cars also contribute to road queues and require parking space. Thus, it may be desirable to reduce the number of private cars in an area regardless of engine type. For this, we propose an embodiment with passenger discount on fees depending on the number of passengers in private cars. The passenger discounts should be large enough to make them attractive, but not make sharing a car more attractive than using public transport. For example, one passenger may qualify for a fee reduction of 40%, two passengers 60% and three or more passengers 80%. The reductions in a real embodiment depend on the original fee level, the price and availability of public transport and probably other factors.

In embodiments with a passenger discount, the number of passengers should be verified by digital security, as manual enforcement would be too unreliable and expensive. A scheme for such an application is discussed with reference to FIG. 11.

As noted, a fee equals a fee rate multiplied by usage data. The fees are added, and should be presented to the vehicle owner in an easily readable manner, e.g. as a list:

| Date | Item | Amount | Rate | Charged |
|---|---|---|---|---|
| 01.02.2016 | Arling S - Barling N, Payzone_1 | 10 km | 1/km | 10.00 |

-continued

| Date | Item | Amount | Rate | Charged |
|---|---|---|---|---|
| 01.02.2016 | Carling, Emission $NO_x$, rate_3 | 5 km | 4/km | 20.00 |
| 02.02.2016 | Carling, Emission $NO_x$, rate_1 | 10 km | 1/km | 10.00 |
| . . . | | | | |
| 29.02.2016 | Passenger discount, 2 passengers | | | −5.00 |
| Total: | | | | xxx.xx |

In the above list, Payzone_1 represent a toll road or central area in which the system 100 would charge a mileage based fee and vehicles without a secure device 110 would be charged a fixed fee. Rate 1 is the estimated emission rate for diesel/petrol times a rate for private cars as explained above. Rate_3 is four times rate_1 as an example of different fees in different temporary zones 221-223. For example, on 01.02.2016 there were two consecutive hours in Carling qualifying for zone 223 with associated emission fees. The day after, the $NO_x$ level in Carling was reduced and a lower fee was charged.

If presented on a user terminal 112, the list above could comprise check boxes to facilitate validation. For example, a vehicle owner might click or touch a box to select all items and then another box next to an item to which he disagree. Deselected items must be handled separately, and are not part of the present invention. After selecting, the vehicle owner clicks or touches a submit button to submit the validated fee data.

The above display and procedure may be performed in a web browser with a secure connection, i.e. HTTPS, to a secure webserver. Once the fee data are submitted, the webserver should delete all validated, i.e. ticked off, items, and retain only a fee summary, e.g: Fee summary

| | |
|---|---|
| Tollroads, payzone 1: | 10.00 |
| Emission, $NO_x$: | 50.00 |
| . . . | |
| Passenger discount | 90.00 |
| Sum: | xxx.xx |

The fee summary contains no positioning data, e.g. information about when the vehicle drove the distance between Arling and Barling in the example above. This reduces the possibility for misuse of private data. If desired, the detailed list may be stored on the vehicle owner' computer before or during the final validation. This enables the vehicle owner to review historical data and produce useful statistics.

If the vehicle owner does not validate the fee data before a certain due date, e.g. around the fifteenth in each month, the fee data may be validated by consent. That is, the fee data in the central system at the end of the due date are valid and will be charged.

If present, the secure device 110 preferably computes the fees, provides the detailed list to the vehicle owner on user terminal 112 and submits the fee summary to the central system 101. Thus, the functions and benefits are equal in the latest two examples. A vehicle owner concerned about privacy may install a secure device 110 or validate fee data on a secure website every day if desired. Vehicle owners less concerned about privacy may leave the fee data as they are until the end of the maximum period, at which time they will be validated automatically. Every vehicle owner is obliged to pay the fee, regardless of whether they validated the fees or not.

Figure 3:
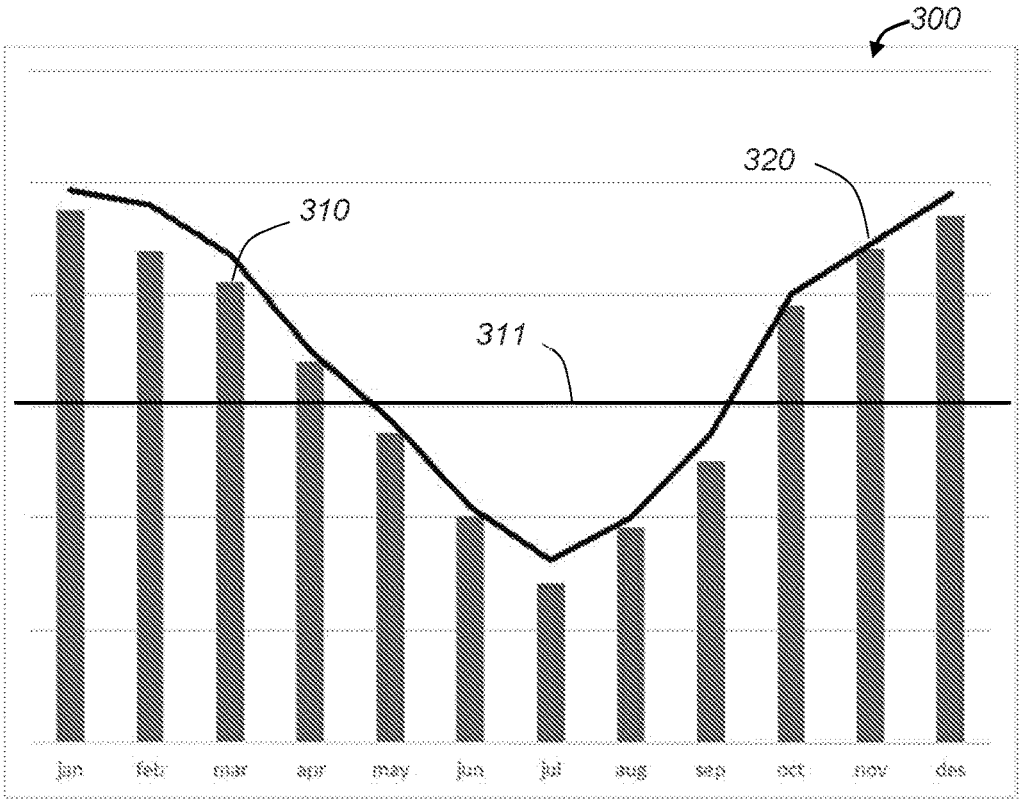
FIG. 3 illustrates seasonal variations.
Figure 4:
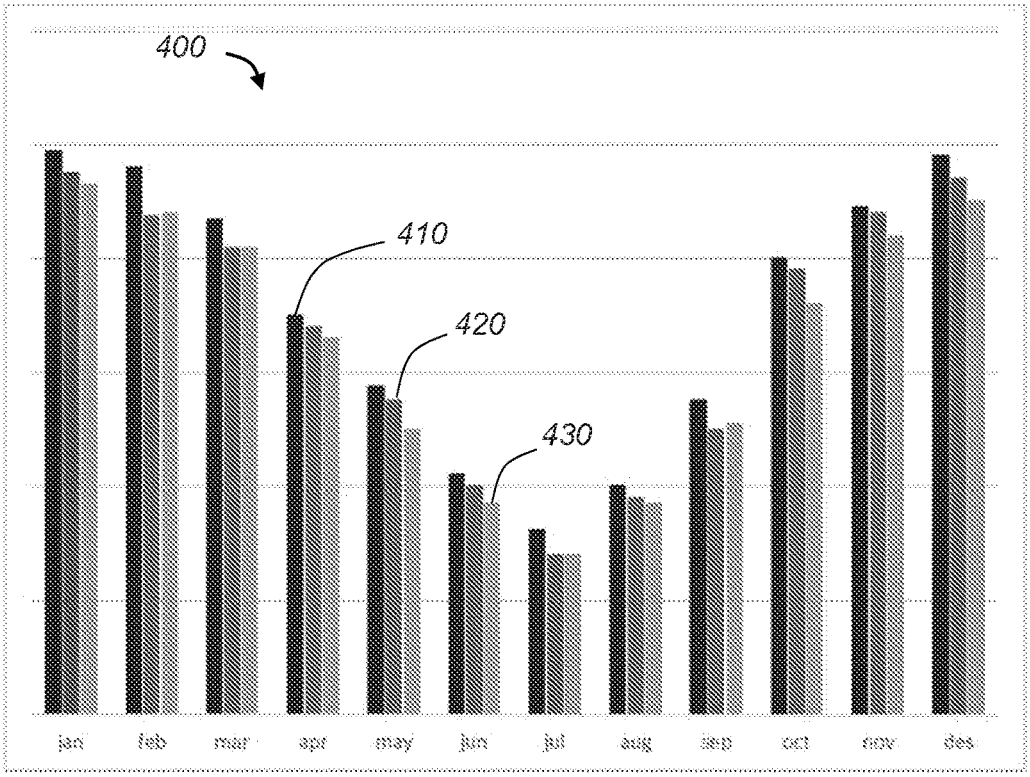
FIG. 4 is a chart showing historic data.

FIGS. 3 and 4 illustrate reports that may be useful for responsible authorities and/or vehicle owners.

FIG. 3 shows seasonal variation 300 of $NO_x$ concentration in ambient air over a calendar year. The bars 310 are monthly averages in a year to be analysed, and curve 320 represent monthly averages from a previous year. A human easily recognises that there are no significant differences in most months, and hence no need for further analysis of the differences for March, April, etc. The reductions in February and July may be investigated further using statistical analysis. For example, it is worthwhile to check if the reduction in February is indeed significant before using time and resources on further investigations. Assuming that the reduction in July is statistically significant, standard hypothesis testing would provide results such as "the July reduction is due to last year's smog within a 95% confidence interval".

Line 311 represents an annual average, which may be useful in long term trend analysis. Examples are provided in FIGS. 9 and 10.

FIG. 4 shows seasonal variations for the last three years represented by bars 410, 420 and 430. The bars 410-430 represent fees charged to a vehicle, and are suitable for display on the vehicle owner's user terminal 112. Historic data may enable the vehicle owner to see if his change in driving pattern and vehicle usage has had an impact on his environmental footprint.

Real implementations of system 200 will generate reports with text and graphics. The examples in FIGS. 3 and 4 illustrate that graphics convey complex information to human beings in an efficient manner. Similarly, while the VMS 240 may convey simple messages, there is a limit to how much text it can display. More important, there is a limit to how much information a motorist can absorb from text on the VMS 240.

Figure 5:
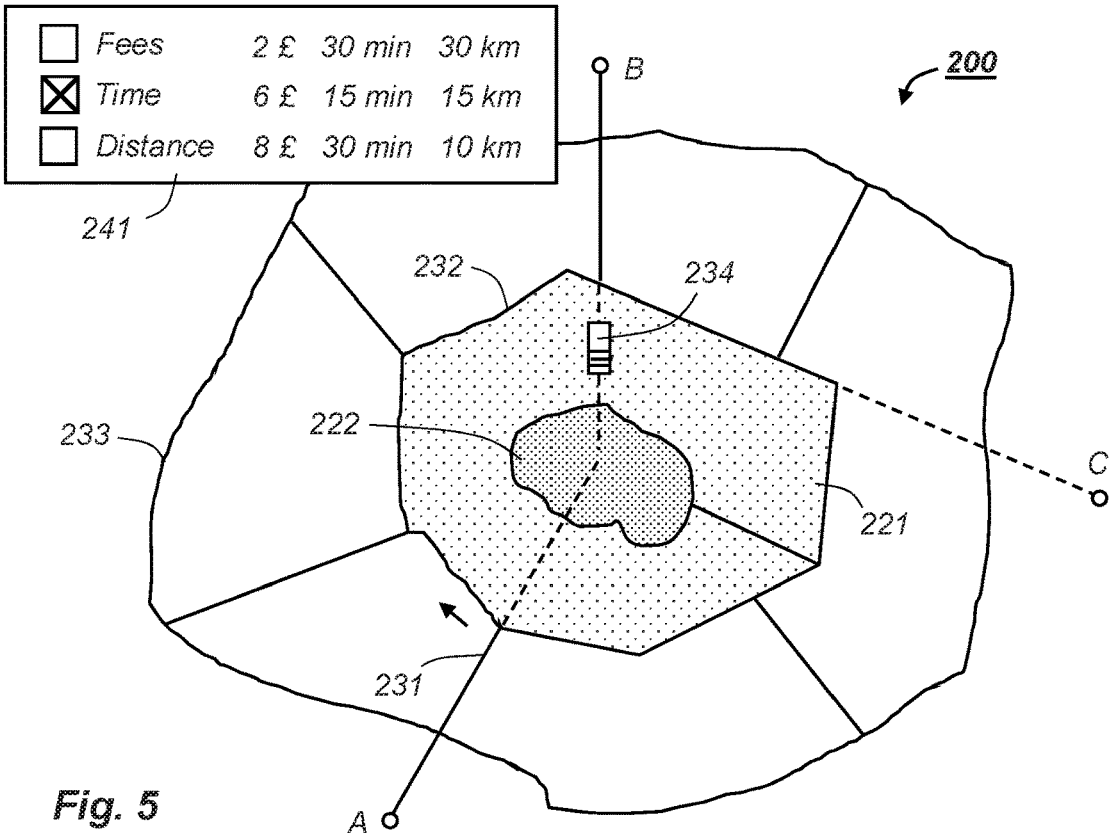
FIG. 5 illustrates a motorist's view of the system

FIG. 5 illustrates a motorist's view of the system 200. The view is a road map with suitable symbols and backgrounds, e.g. as known from some car navigation systems and websites. The zones 221-222 may be assigned background colours to indicate health hazard. For example, white, yellow, bright red and lilac backgrounds may illustrate concentrations that are 'harmless', 'harmful to sensitive people', 'harmful' and 'very harmful', respectively.

Preferably, a user can select one of several display modes indicating levels of pollution or level of fees. Different display modes may have different colour schemes. For example, in a mode indicating $NO_x$-level and using the yellow to lilac colour scheme, the zones 221 and 222 might be displayed with yellow and red backgrounds, respectively. In a different display mode indicating concentrations of dangerous airborne particles, i.e. $PM_{10}$ and/or $PM_{2.5}$, the background of zone 221 might be a sandy yellow and the background in zone 222 might be a darker shade to indicate an increased concentration of airborne dust. Other display modes may include an 'air quality'-mode indicating a weighted sum of several pollutants representing health hazard and a 'fee mode' indicating different fee levels.

Preferably, the displayed information depends on the vehicle. For example, the console of an electric vehicle may display white backgrounds in zones 221, 222, whereas a user terminal associated with a combustion engine might display zones 221, 222 with different background colours. Current web servers and browsers can provide vehicle specific information, so the system 100 is not needed for this purpose.

Streets and/or a ring road, e.g. road 232, delimit each zone 221 and 222. If the air pollution exceeds a predetermined level, the area within ring road 233 may become an additional temporary pollution zone with a raised fee as described with reference to FIG. 2. Several streets or roads, illustrated by radial straight lines in FIG. 3, connect the ring roads 232, 233. Thus, there are numerous routes through and around the mesh, e.g. from A to B. The system 200 preferably offers different routes from a current position to a destination based on certain criteria, e.g. the least expensive route, the fastest route, the shortest route etc.

Assume, for example, that a vehicle is at A, the driver has entered B as the destination and the car console displays the map in FIG. 5. Checkbox 241 enables the driver to select between three alternative routes. In a real embodiment, the checkbox 241 might also have a field for entering different destinations, e.g. C. In the present example, option 'Fees' provides the least expensive route from A to B along the ring road 233. Here, the 'Fees' alternative is also the route with least air pollution because the fees increase with increasing air pollution, In FIG. 5, the user has selected the 'Time' option, which provides the fastest route. In the present example, the fees associated with the 'Time' option are three times those of the 'Fees' option, but the estimated time to B is less than in the alternatives. Route 231 straight through the most polluted zone 222 is the most expensive due to a temporary pollution fee. Route 231 is also the shortest, and would normally be the fastest route. However, in this example, a queue 234 in zone 221 makes the detour along ring road 232 faster. A small arrow is located at the junction where the vehicle should leave route 231. The console in another vehicle, e.g. a zero-emission car or a lorry, might display different routes in checkbox 241, as the vehicle might be eligible for different fees.

Figure 6:
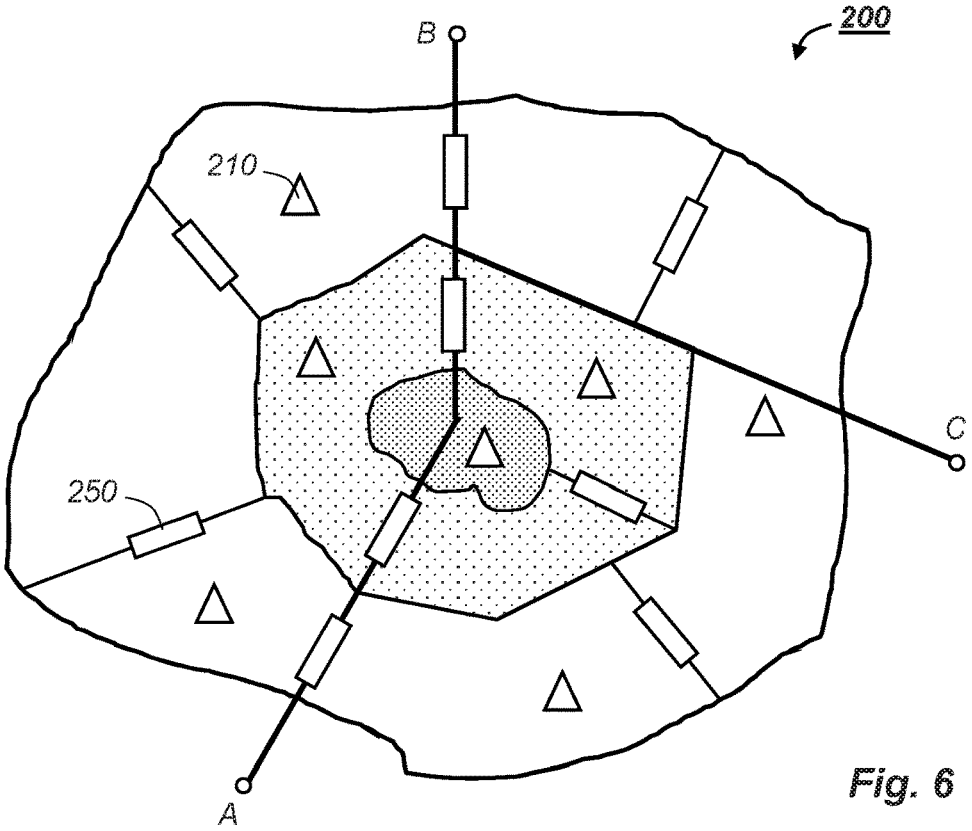
FIG. 6 illustrates a traffic operator's view of the system.

FIG. 6 illustrates an operator's view of the system 200 aimed at operators in a traffic control centre. The road map is similar to the map in FIG. 5, but the symbols are different. For example, main roads between A and B and between B and C are drawn with thicker lines to indicate desired paths through the network. In a real embodiment, these paths might have a different colour, and have the same thickness as, for example, the outer ring road to indicate their capacity, e.g. number of lanes. The measurement stations 210 provide pollution levels as described with reference to FIG. 2, and the temporary pollution zones are the same as in FIG. 5.

Perceived resistors 250 are entities that affect the traffic flow similar to resistors affecting current in an electric circuit. The perceived resistance increases when an associated fee increase, so a temporary raise of fees on roads leading to a polluted area will cause a temporary change in the flow of traffic. Symbols representing location, size and direction of queues, e.g. similar to the symbol 234 in FIG. 5, status of an incident etc. are omitted from FIG. 6 for clarity. However, it is understood that the operator's view is that of a current traffic control system with added information about pollution and related fees.

FIGS. 5 and 6 illustrate different views of an underlying graph with nodes and edges, where the edges represent some metric or cost. For example, the motorist's view in FIG. 5 aims at conveying complex information from the graph to a motorist, and the options in checkbox 241 are computed by minimising different metrics on paths through the graph. The colour and thickness of path A-B and the symbol for perceived resistor 250 are examples of common ways to display an edge in current network monitoring systems.

Figure 7:
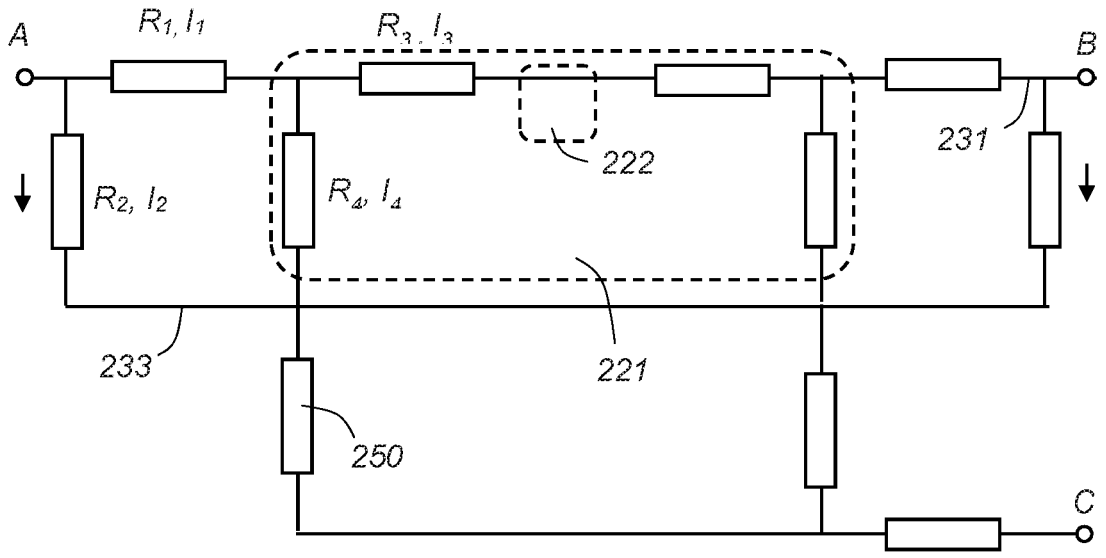
FIG. 7 illustrates a network layer associated with the system.

FIG. 7 illustrates a network layer of the system 200. The purpose of this layer is to provide a basis for network analysis, e.g. to facilitate planning and expansion of the system 200 in a systematic manner as opposed to adjusting fees and collection points by trial and error. For similar reasons, network analysis is widely used in many fields, including traffic control, econometrics, production planning etc.

In FIG. 7, $R_1$-$R_4$ represent perceived resistors as defined with reference to FIG. 6. $R_1$ and $R_3$ are associated with temporary fees that are charged if the pollution level in zones 221, 222 exceed predetermined thresholds. In a normal state, $R_1=R_3=0$ and the average motorist traveling from A to B prefer route 231 over the longer route 233. This is desired, as a longer route means more vehicle kilometres and more emission. The perceived resistance $R_2$ prevents motorists from choosing route 233 over route 231. By analogy to Ohm's law:

$$R_2/R_{231}=I_1/I_2=(\#\text{vehicles passing } R_1)/(\#\text{vehicles passing } R_2) \quad (1)$$

where $R_2$ and $R_{231}$ are the perceived resistances associated with routes 233 and 231, $I_1$ and $I_2$ represent the traffic flow from A to B along routes 231 and 232, respectively, and both numbers of vehicles are counted in one or more periods when $R_1=R_3=0$.

The perceived resistors $R_1$-$R_4$ relate to some local reference and may thus be expressed as relative values. That is, the perceived resistors are defined by how they affect local traffic, and there is no need to estimate their 'absolute values' e.g. in equivalents of time or money. In this example we choose $R_{231}$ as reference and set $R_{231}=1$.

On the first day the pollution in zone 221 exceeds a predetermined value, the fee associated with $R_1$ is set to a non-zero best guess, and $R_3$ is deliberately set to zero. i.e. $R_1\neq 0$ and $R_3=0$. Denoting the new traffic flows $i_1$ and $i_2$ and using the reference value above, the equivalent to Ohm's law yields:

$$R_1=i_1/i_2/R_2-1 \quad (2).$$

Equation 2 merely illustrates that the perceived resistance $R_1$ can be obtained from the observed shift in traffic flow, and is not a general result. Specifically, the ratio $i_1/i_2$ is estimated by counting vehicles in periods when $R_1\neq 0$ and $R_3=0$ in the same manner $R_2$ is estimated using equation 1.

By analogy to Kirchhoff's law, the number of vehicles entering a node equals the number of vehicles exiting the node. Thus, the network in FIG. 7 is a resistive network, and any perceived resistance $R_1$-$R_4$, . . . may be estimated by proven techniques. For example, a Norton equivalent may be defined between any two points in the network.

Figure 8:
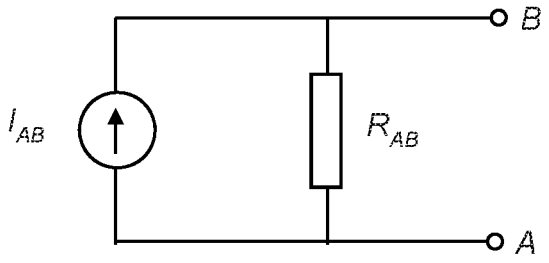
FIG. 8 illustrates practical use of the network layer.

FIG. 8 illustrates the Norton equivalent for the network between A and B, which includes an imaginary traffic source $I_{AB}$ and an equivalent perceived resistor $R_{AB}$. $I_{AB}$ and $R_{AB}$ can be established once, and later calculations of the traffic flow exiting at B from the traffic flow entering at A are easily performed using the Norton equivalent in FIG. 8. In general, Norton equivalents enable a planner to concentrate on any part of the network, e.g. a central area, and to replace all other parts of the network with a simple equivalent circuit. Thus, the network layer with perceived resistors $R_1$, $R_2$, etc. reduce the risk for unintended effects associated with a trial and error approach.

Other useful formulas include the Erlang-C formula, which expresses the probability for a queue in terms of incoming load and the number of servers. The incoming load can be easily determined, e.g. by traffic counts, and the servers may be anything serving a queue, e.g. number of lanes, available public transport or parking space. Erlang-C also provides related parameters such as service levels, average waiting times etc.

The general techniques for network analysis briefly described above and related techniques are certainly available in generic network analysis tools, e.g. used for planning and controlling telecom networks. They should also be available in many traffic control systems. Thus, existing systems may be upgraded to handle measurement stations 210 and pollution fees as described. There is no need for a full system development.

Figure 9:
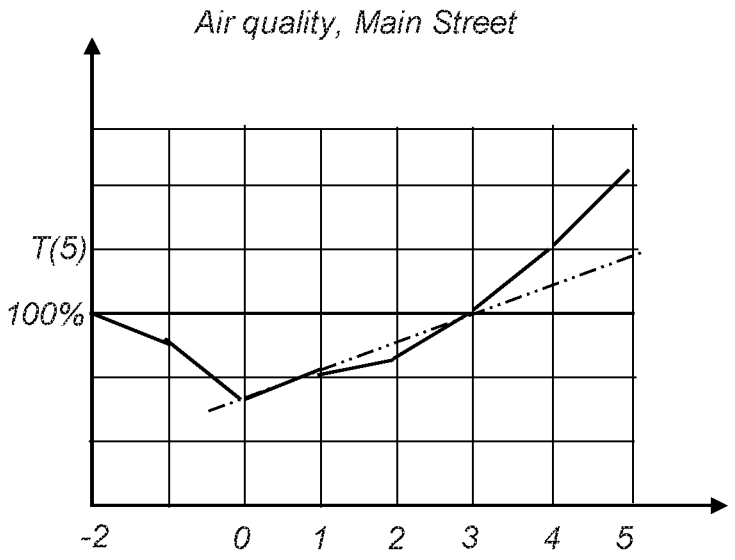
FIG. 9 illustrates a decision maker's view of improved air quality.
Figure 10:
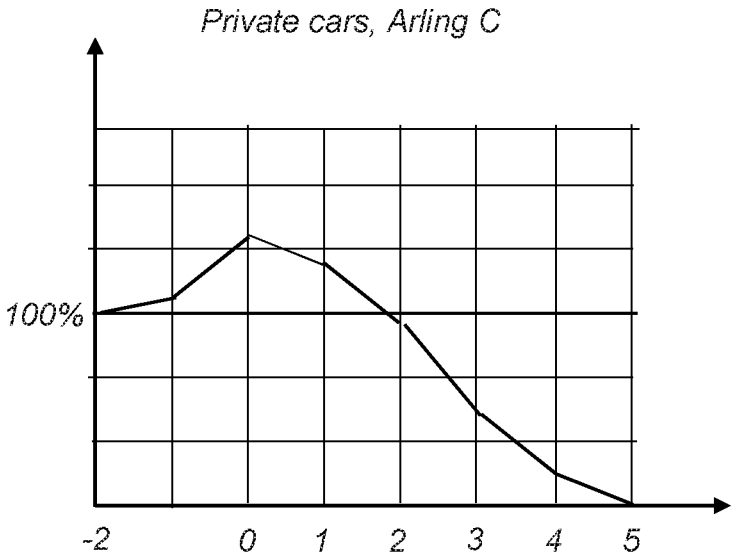
FIG. 10 illustrates a decision maker's view of reduction in traffic.

As noted, there is a need for political revision at regular intervals, e.g. once a year. FIGS. 9 and 10 illustrate the proposed system 200 from a decision maker's view.

FIG. 9 illustrates a first target type, improvement in air quality. As above, 'air quality' may regard a single substance, e.g. $NO_2$ or $PM_{10}$, or several substances. 'Main street' refer to an easily recognisable and representative location. For example, CAL reports the concentration of $NO_2$ in Marylebone Road as an indicator of air quality. In FIG. 9, a reference level 100% represent an annual average two years before the implementation of the system 200 in year 0, and the dash-dot line is a straight line from the air pollution in year 0 to a target pollution T(5) defined in year 0 for the end of year 5. In year 2, the annual average was below the dash-dot trajectory. This indicates that the fee level was somewhat low at the revision in year 2. In the revision of year 2, local politicians decided to raise the fee level according to advice from a responsible authority. The decision brought the air quality back to the reference level in year 3, at which time the politicians were offered two new alternatives:

A) maintain the fee level and achieve the target T(5) ahead of time and

B) lower the fee level and achieve the target T(5) on time.

From the solid curve, it appears that the politicians selected alternative A, as the target value T(5) was reached in year 4, i.e. one year ahead of time. Of course, alternative A may have included an option to adjust target T(5).

Consider next the close correlation between the dash-dot target line and the solid line between year 0 and 1. To achieve this, some flexibility must be left to the responsible authority, and the politicians should merely revise overall fee rates and/or ranges. As an example and referring back to FIGS. 5 and 6, the temporary pollution fees for entering zone 222 might initially be 2.0 times those for entering the less polluted zone 221 for all private cars. Assume that, a few months after the initial decision in year 0, it becomes clear that this ratio should be increased from 2 to at least 3. As diesel cars emit more $NO_x$ than petrol cars, a new average 3.1 could be achieved by raising the ratio to 4.0 for diesel cars and 2.9 for petrol cars. Further, a desired ratio 3.1 could be achieved by lowering the fees in zone 221 and increasing fees in zone 223 to maintain the fee level approximately at the original level, even on the few relevant bad air days. This flexibility would be impossible if politicians were asked to decide on actual fees in zones 221 and 222 rather than fee levels and ranges.

Technically, the system 200 is a closed loop control system when viewed over several years. In this case, annual averages may provide the feedback, e.g. as shown in FIG. 9. When viewed on a time scale less than a year, system 200 is an open loop system with empirical data and constants determined by a previous political revision. Both kinds of control systems are much studied, and there are effective methods for optimizing them. For example, a Kalman filter may provide estimates for a next state of the system 200 based on inputs from measurements containing statistical noise. Kalman filtering involves a prediction step that involves a system model. The system model for system 200 could include network equivalents such as the perceived resistors shown in FIGS. 6 and 7. In addition, the system model must include the fee structure, which may be expressed as:

In mathematical terms, the total fee $F_v$ charged to a vehicle 10 may be expressed as:

$$F_v = \sum_i r_i(\text{class, type}) \cdot M_i \cdot [pos \subset payzone] \cdot C_i \cdot [C_i > C_{T,i}] \quad (3)$$

where $F_v$ is a fee charged to a vehicle $r_i$(class,type) is a fee rate depending on class and type of the vehicle, $M_i$ is a mileage,

[pos⊂payzone] is an Iverson bracket: 1 if the vehicle is within the payzone, else 0, $C_i$ is the concentration of a substance, e.g. $NO_x$, $PM_{10}$ etc.

$\lfloor C>C_{T,i} \rfloor$ is an Iverson bracket: 1 if $C_i>C_{T,i}$ i.e. a threshold, and 0 otherwise.

The emission fees described previously is a product of a rate, a concentration and a mileage, and are thus included in equation (3). In addition, equation (3) includes mileage based fees ($C_i$=1) and the payzone may include a limited time range to allow the temporary pollution zones 221-223 as well as permanent payzones, e.g. defined for a congestion fee.

FIG. 10 illustrates another possible target, namely a reduced number of private cars in central Arling. Private cars may include electric and hydrogen cars. The first axis define years and introduction of system 200 in year 0 as in FIG. 9. The system 200 may contribute to such a decline, e.g. by imposing higher fees on private cars than on vans with a documented task of delivering goods in the area, and no fees on public utility vehicles. Improved public transport, regulations and other tools from the politician's toolbox also contribute to the desired decline. In the example of FIG. 10 and in general, even a simple model based on the general techniques briefly discussed above is likely to produce better results than a trial and error approach. In particular, a systematic approach reduces the risk for unintended effects.

The system 200 permits achieving several goals at once. Consider, for example, a vehicle owner living in a rural area with infrequent public transport. The vehicle owner has a heavy private car with a diesel engine and studded tires to fit the needs in the area where she lives. One day, the vehicle owner is late for an important meeting, and checks a website for the fastest route before leaving home. For once, the vehicle owner decides to take the shortest route despite substantial temporary pollution fees. Most other motorists, including many driving petrol cars, avoid the polluted area to avoid the fees. Indeed, the vehicle owner is likely to choose the least expensive alternative for several subsequent days. The least expensive alternative may also be the most environmentally friendly alternative as fees increase with usage and pollution.

As indicated, a passenger discount may induce some drivers to bring along passengers, and thereby contribute to the decline in road traffic illustrated in FIG. 10. Currently, a similar approach allows vehicles with passenger(s) in certain lanes otherwise reserved for public transport. As noted with reference to FIG. 2, manual enforcement of such rules is too expensive and unreliable. We propose an alternative that associate a passenger with a user terminal 112, e.g. a smart phone, PDA or tablet. A passenger entering the car is simply asked to register using her smart phone to make the vehicle owner eligible for a passenger discount.

Before proceeding to the details of FIG. 11, we note that any system is considered secure if the cost of violating the security exceeds the possible benefit, e.g. the passenger discount obtainable for four passengers every working day. Due to the relatively small amounts involved, the risk for fraud is limited. For example, few motorists would acquire four mobile phones just to get a discount worth a fraction of the price. Similarly, few people would ask friends, neighbours or colleagues to commit fraud just to save a relatively small amount, and few friends, neighbours or colleagues would register fraudulently on a regular basis. Hence, the scheme in FIG. 11 is designed to make fraud relatively expensive, but not impossible.

In a first embodiment, a passenger counting system might be implemented using a simple message service, e.g. SMS, without a hash or signature to prove origin and integrity of the messages. However, this allows a fraudulent driver to deny that he requested a passenger count, and/or to claim that a malicious interceptor must have altered the message in transit. Missing encryption would permit any eavesdropper on a public network to collect passenger IDs during the journey. This may not be a problem, but the desired nonrepudiation and confidentiality may be achieved at low cost, and thereby be worthwhile. Specifically, the sufficient security is obtained by installing a relatively short private key/public key pair. Suitable functions to encrypt and decrypt messages are available on most SIM-cards for mobile devices. Full login(s) to authenticate the driver and/or passengers may be too extensive for the present application, and make the application less user friendly.

For similar reasons of cost versus value, the scheme in FIG. 11 accepts passenger registrations anytime during a journey or before an expiration time. The expiration defines an upper limit for when a passenger is allowed to register, and any passenger count at the time of expiration is valid by definition. The driver should be allowed to manually end the journey at any time before expiration, and thereby delete information that can identify the passengers.

Alternatively, passengers might be required to register when they enter and when they leave the vehicle. However, most passengers will ride along for most of the way in most vehicles, so requiring two registrations instead of one would reduce the discount with a relatively small fraction, e.g. 5-10%. If revenue is an issue, a small adjustment of discount rates will achieve comparable savings. On the other hand, recorded entry and exit locations and times for identifiable passengers would be valuable surveillance data, and thus offer a possibility for misuse. Neither decreased privacy nor decreased user-friendliness would cause more motorists to prefer a shared car over his or her own vehicle. Thus, requiring passengers to register twice is unlikely to reduce road traffic and inefficient to reduce public cost.

FIG. 11 illustrates a preferred method 500 for recording a number of passengers during a journey, typically for vehicles 10 in commuter traffic. ###

In a first embodiment of the present invention, each passenger has a unique ID-card identifying the owner. As shown in FIG. 1, a card reader 150 may be connected to the secure device 110, e.g. by a USB-cable. A person may insert a personal card 151 into the reader 150 and enter a PIN to verify that he or she is the owner of the card. The card reader 150 should read a passenger ID unique for the owner. The card and PIN is an example of two-factor authentication suitable for connecting a person to a digital passenger ID. The USB-cable connects the card reader, and thereby the authenticated person, to the vehicle 10. This prevents someone in a remote location from registering as passenger for a journey.

The unique passenger ID read by the card reader 150 is added to a passenger list for counting passengers as further described below. Some private and public organisations provide machine readable cards, e.g. tickets issued by public transport companies, smart cards for banking applications or secure networking or ID-cards issued by some governments. However, large scale distribution of new smart cards or electronic devices comprising a unique passenger ID for a traffic application is expensive.

FIG. 11 illustrates an alternative embodiment, in which a passenger's user terminal 112, e.g. a smartphone, tablet, PDA or laptop replaces the ID-card as a factor in authenticating the passenger. The main benefit is that all passengers are likely to carry such a device in a journey from home to work or back. A vehicle server 160 comprises a passenger list 162 and processes running in the vehicle 10, e.g. in a secure device 110 of the system 100 or in a mobile device 112 belonging to a driver of the vehicle 10. A short range network, e.g. WiFi or Bluetooth, provides the short range connection between the user terminal 112 and the vehicle server 160, and thereby associates the user terminal 112 with the vehicle 10 for the journey.

FIG. 11 also illustrates the main steps in a method 500 for computing a passenger discount. In step 510, the vehicle server 160 creates a 'journey' data structure identified by a vehicle ID and a fixed expiration. The newly created data structure 'journey' comprises an empty passenger list, and is preferably created in the vehicle server 160 to save traffic over the public network 140. The passenger list may have a maximum number of items, e.g. the number of passenger seats in the vehicle.

In embodiments with a private, local network in the vehicle 10, the step of creating 210 a data structure may involve sending local connection data for the vehicle server 160, e.g. an SSID and a passphrase for a WiFi network, to the public server 101. In response, the public server 101 stores the local connection data for the vehicle server 160.

Step 520 is performed for every passenger registering during the journey, and comprises a request for local connection data for the vehicle server 160. The public server 101 returns a message 524 with the requested data, and the user terminal 112 is able to connect directly to vehicle server 160. There is no need for manual input or reconfiguration for WiFi, Bluetooth etc. in the user terminal 112 and/or vehicle server 160. This facilitates use of the present invention for the driver and regular passengers as well as for a random passenger registering for one journey in the vehicle 10.

In step 530, the passenger's user terminal 112 submits a passenger ID unique to the person possessing the user terminal 112. The vehicle server 160 may respond 534 with a receipt for registering as passenger for the journey. The optional step 534 enables the owner of user terminal 112 to document several journeys in a certain period and/or collect a small amount for motivating people to register as passengers, e.g. in commuter traffic.

One of the processes 163 in the vehicle server 160 checks for duplicate passenger IDs in a passenger list. For example, a passenger ID associated with the driver of the vehicle 10 should not increase the passenger count. A passenger submitting his or her passenger ID more than once during a journey, possibly from different user terminals 112, should receive a message that he or she is already registered for the journey. Thus, there is no need for fines or other expensive enforcement to prevent fraud, and a function to confirm registration on the user terminal 112 becomes optional.

In step 540, the vehicle server 160 submits the passenger count to the public server 101. The passenger list containing passenger IDs and other private data are not needed for counting a number of passengers, and are thus deleted from the vehicle server 160.

In a passenger discount system, the vehicle ID and an expiration time are required to identify a journey, and the passenger count is needed for computing the discount. A public server 101 is required to collect and compute fees and discounts The scheme illustrated in FIG. 11 eliminates the need for entering local connection data manually and/or reconfiguring the vehicle server 160 to accommodate a random passenger. As the public server 101 is required anyway, it is relatively inexpensive to make it provide local connection data.

The communication over the public network 140 may be conducted on any network layer using any suitable protocol. For example, the driver's request in step 210 might use SMS on a mobile network 140 to send a code word and vehicle ID to a predefined number, e.g. "jstart AB12345" to number 9876. Alternatively, the request 210 may connect to a webserver on the application layer, e.g. by an URI such as "https://example.com/AB12345", which includes the vehicle ID. The URI may be available from the 'Favourites' folder in a web browser, a QR-code on a console or a sticker in the vehicle 10, etc.

A dedicated application downloaded from a central store and installed on the user terminal is a practical alternative regardless of protocol and algorithm. Such an application may have options for registering as a driver or a passenger, and use system calls to access data and functions, e.g. the passenger ID or functions for encryption, decryption and hashing. A dedicated application may be signed by the issuer, and thereby cryptographically hard to modify. Proven cryptographic techniques may easily make the cost of reading or altering data or the software orders of magnitude larger than the gain obtainable from reading or altering a passenger count, and thus make eavesdropping or malicious alteration uninteresting or impossible for everyone with the possible exception of state level adversaries.

Specifically, encryption keeps the content of a message confidential, whereas hashing ensures the integrity of the contents. Digital nonrepudiation includes determining origin of data with reasonable certainty. For example, encryption ensures that an eavesdropper on the network 140 cannot see a passenger's approximate position at a certain time. Hashing ensures that neither software nor the passenger count sent to the public server can be altered without being detection. Thus, the driver cannot be suspected for manipulating the passenger count. Nonrepudiation enables the authority operating the public server 101 to prove that a certain vehicle server 160 sent a certain passenger count, and that the authority could not possibly have altered the passenger count after reception.

For encryption, hashing and providing nonrepudiation, the public server 101, vehicle server 160 and each user terminal 112 are provided with unique pairs of cryptographic keys. Each key pair comprises a private key and a corresponding public key. A message encrypted with a public key can only be decrypted using the associated private key. The public key cannot decrypt the message, and is available to all communication partners, e.g. as part of a message or on request. Similarly, the public key can decrypt a message encrypted with a private key. Thus, if a message decrypted with a public key is readable, the sender must have access to the private key. The key pair eliminates a need for a central register of secret keys and secure channels, e.g. couriers, to distribute secret keys. The security depends on that the private key remains secret at all times.

Keys preinstalled in the SIM-card of a mobile device are usually not used for authentication, as there is no way to know if the alleged private keys are actually secret. However, current SIM-cards may comprise useful cryptographic primitives, e.g. secure functions for encryption, decryption, hashing or a combination. These functions run in a protected smart card, and are invoked by some mobile banking applications. The transport layer security (TLS) protocols for Internet applications define suitable algorithms and recommendations for encryption, hashing etc.

A first implementation of a web-based version may use readymade functions for handshaking, encryption and hashing, e.g. as defined in current TLS protocols. However, these demand more computing and battery power than strictly required, and a less demanding procedure is preferred to save battery power, e.g. for environmental reasons. Our co-pending Norwegian patent application, entitled "System and method for counting passengers in a road vehicle" has more details.

While the invention has been described by way of examples, various alternatives and modifications will be apparent to one skilled in the art. The invention is defined by the accompanying claims.

The invention claimed is:

1. A system for controlling road traffic, comprising:

a display for informing motorists of a raised pollution fee in a pollution zone with predetermined geographical boundaries;

a measurement station configured for measuring an air pollutant concentration in ambient air; and a central system configured to form the pollution zone when the air pollutant concentration exceeds a threshold value and charge a pollution fee to a vehicle moving in the pollution zone wherein the central system comprises a public server for recording a journey ID and an associated passenger count, the system further comprising a vehicle server within the vehicle and a machine-readable passenger token for providing a passenger ID unique for each passenger, wherein the public server and the vehicle server are nodes in a public network, and the public server is configured to record the associated passenger count as the number of distinct passenger IDs that is/are read by the vehicle server over a short-range connection during a journey identified by the journey ID, wherein the air pollutant concentration and the threshold value are expressed as averages over a predetermined period, wherein the pollution zone has a predetermined minimum duration, and wherein the predetermined minimum duration prevents a temporary decrease in a running average of the air pollutant concentration from removing the pollution zone.

2. The system according to claim 1, wherein the air pollutant is selected from a group comprising nitrogen oxides ($NO_x$), particulate matter (PMio and PM2.5), sulphur oxides($SO_x$), lead, volatile organic compounds and carbon monoxide (CO).

3. The system according to claim 1, wherein the pollution fee comprises a fee rate depending on properties of the vehicle multiplied by usage data depending on the air pollutant concentration.

4. The system according to claim 1, wherein a private car, a private utility vehicle, a public utility vehicle and an emergency vehicle are eligible for different pollution fees if all other parameters relevant for the pollution fee are equal.

5. The system according to claim 1, wherein the pollution fee for an emergency vehicle is zero.

6. The system according to claim 1, wherein the pollution fee increases with the weight of the vehicle.

7. The system according to claim 1, wherein the pollution fee increases with distance travelled.

8. The system according to claim 1, wherein the pollution fee increases with increasing emission from the vehicle.

9. The system according to claim 1, wherein the pollution fee includes a fee for studded tires.

10. A method of controlling road traffic through a pollution zone comprising:

measuring an air pollutant concentration in ambient air by a measurement station, wherein the air pollutant concentration and a threshold value are expressed as averages over a predetermined period;

forming a pollution zone having predetermined geographical boundaries based on the air pollutant concentration exceeding the threshold value by a central system, wherein the pollution zone having a predetermined mini mum duration and wherein the predetermined minimum duration prevents a temporary decrease in a running average of the air pollutant concentration from removing the pollution zone;

charging a pollution fee to a vehicle moving in the pollution zone by the central system, wherein the central system comprises a public server and a vehicle server within the vehicle, and the public server and the vehicle server are nodes in the public network;

informing motorists of a raised pollution fee in the pollution zone by a display;

recording a journey ID and an associated passenger count by the public server;

recording a machine-readable passenger token for providing a passenger ID unique for each passenger by the public server; and recording the associated passenger count as the number of distinct passenger IDs that is/are read by the vehicle server over a short-range connection during a journey identified by the journey ID by the public server.

11. The method according to claim 10, wherein the raised fee causing drivers to divert a fraction of the traffic around the pollution zone.

12. The method according to claim 10, wherein the air pollutant is selected from a group comprising nitrogen oxides ($NO_x$), particulate matter (PMio and PM2.5), sulphuroxides ($SO_x$), lead, volatile organic compounds and carbon monoxide (CO).

13. The method according to claim 10, wherein the pollution fee comprises a fee rate depending on properties of the vehicle multiplied by usage data depending on the air pollutant concentration.

14. The method according to claim 10, wherein a private car, a private utility vehicle, a public utility vehicle and an emergency vehicle are eligible for different pollution fees if all other parameters relevant for the pollution fee are equal.

15. The method according to claim 10, wherein the pollution fee for an emergency vehicle is zero.

16. The method according to claim 10, wherein the pollution fee increases with the weight of the vehicle.

17. The method according to claim 10, wherein the pollution fee increases with distance travelled.

18. The method according to claim 10, wherein the pollution fee increases with increasing emission from the vehicle.

19. The method according to claim 10, wherein the pollution fee includes a fee for studded tires.

20. The method according to claim 10, further comprising creating an empty passenger at the beginning of the journey, during the journey the public server reading the passenger IDs from the passenger token and added to a passenger list.

21. The method according to claim 10, further comprising a short-range connection to ensure that the passenger token is inside the vehicle.

22. The method according to claim 10, further comprising a passenger proving that they are in the vehicle by entering a secret on the vehicle server's console.

* * * * *